United States Patent [19]

Butler

[11] Patent Number: 4,832,392

[45] Date of Patent: May 23, 1989

[54] QUICK LOCKABLE TILTING HOIST TACKLE

[75] Inventor: David L. Butler, Snohomish, Wash.

[73] Assignee: Oberg Enterprises, Inc., Everett, Wash.

[21] Appl. No.: 136,923

[22] PCT Filed: Apr. 15, 1986

[86] PCT No.: PCT/US86/00786

§ 371 Date: Aug. 3, 1987

§ 102(e) Date: Aug. 3, 1987

[87] PCT Pub. No.: WO87/03571

PCT Pub. Date: Jun. 18, 1987

Related U.S. Application Data

[63] Continuation-in-part of Ser. No. 867,186, Apr. 25, 1986, Pat. No. 4,684,162.

[51] Int. Cl.[4] ..... B66C 1/12

[52] U.S. Cl. ..... 294/82.12

[58] Field of Search ..... 294/67.5, 74, 82.11–82.13, 294/86.41; 254/389–391, 403, 411

[56] References Cited

U.S. PATENT DOCUMENTS

| | | | |
|---|---|---|---|
| 2,053,976 | 9/1936 | Stahl . | |
| 2,329,943 | 9/1943 | Robins . | |
| 2,356,147 | 8/1944 | Caldwell | 294/82.12 |
| 2,617,677 | 11/1952 | Pridy | 294/82.12 X |
| 2,620,218 | 12/1952 | Morith | 294/82.12 |
| 2,629,625 | 2/1953 | Phillips | 294/82.12 X |
| 3,254,913 | 6/1966 | Young | 294/82.12 |
| 3,391,957 | 7/1968 | Ehrhardt | 294/82.12 |
| 3,663,051 | 5/1972 | Yu . | |
| 4,684,162 | 8/1987 | Butler | 294/82.12 |

FOREIGN PATENT DOCUMENTS

| | | | |
|---|---|---|---|
| 686969 | 9/1979 | U.S.S.R. | 294/82.12 |
| 1096187 | 6/1984 | U.S.S.R. | 294/82.12 |
| 1576311 | 10/1980 | United Kingdom | 294/82.12 |

*Primary Examiner*—Johnny D. Cherry

*Attorney, Agent, or Firm*—Ward Brown; Robert W. Beach

[57] ABSTRACT

Two separate sling lines (13, 14) have inner end portions secured to a drum (6 or 6') mounted in a block (2 or 2') and are wound in opposite senses around the drum. The block is adapted to be connected to a hoist and the free end portions (15) of the sling lines are adapted to be connected to a load at spaced locations. During or after lifting the load by use of the hoist, the drum can be rotated to haul in one sling line while automatically paying out the other and thereby tilt the load. Mechanism (10, 12 or 8', 30, 35) is provided for locking and unlocking the drum relative to the block.

4 Claims, 4 Drawing Sheets

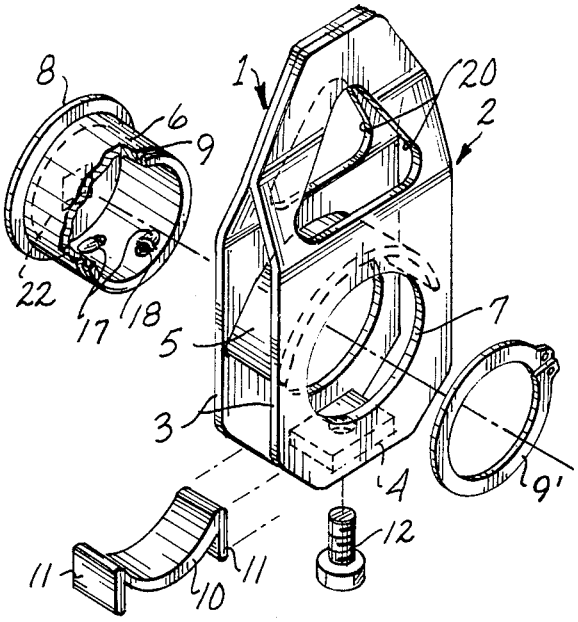
Fig. 1.
Fig. 2.
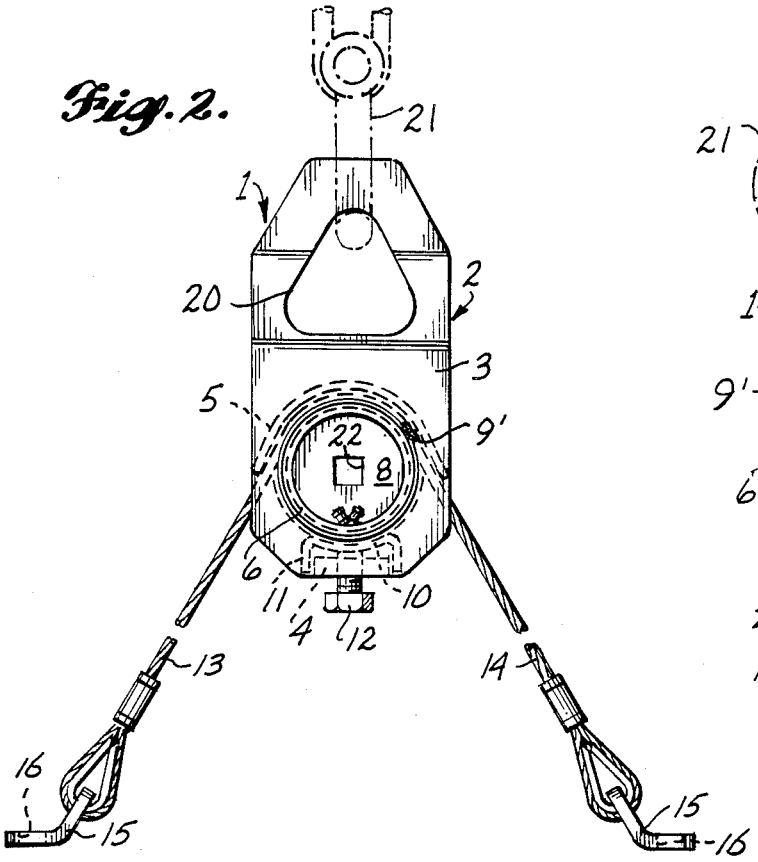
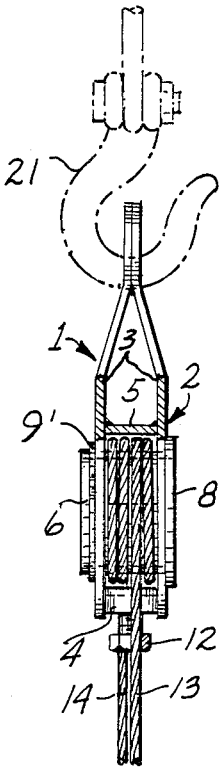
Fig. 3.

Fig. 8.
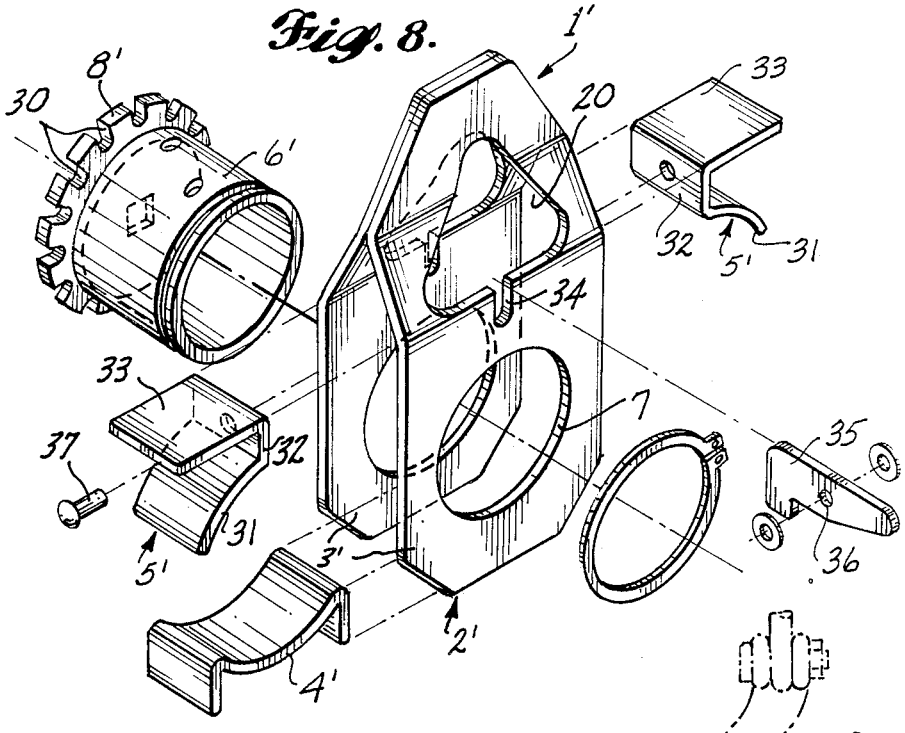
Fig. 9.
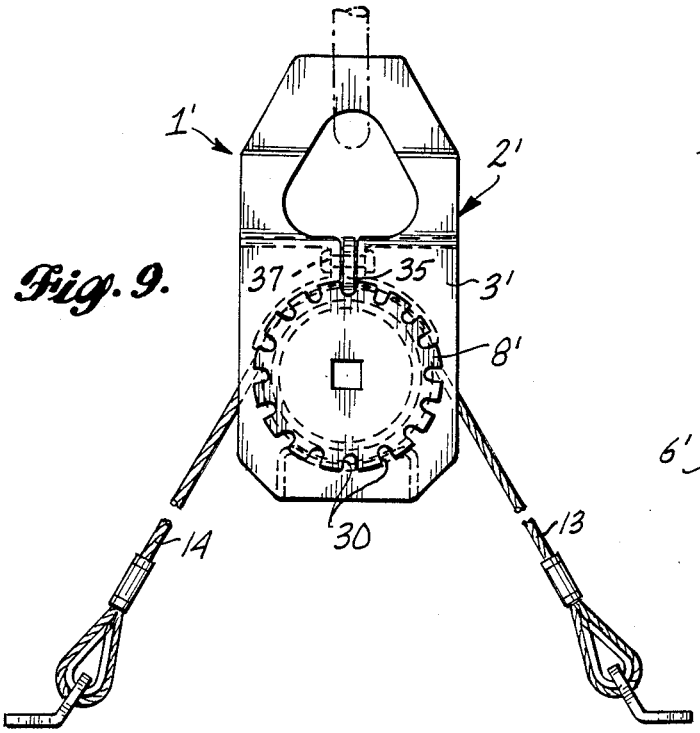
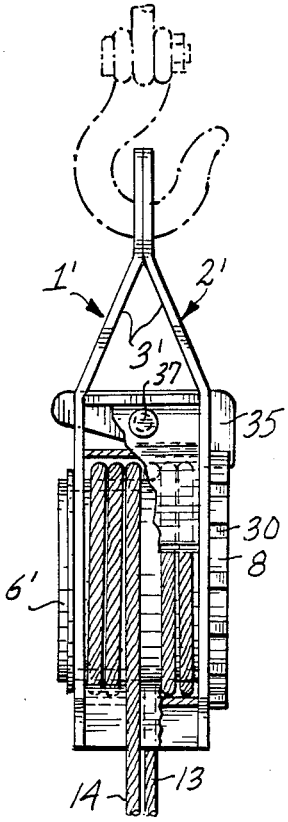
Fig. 10.

QUICK LOCKABLE TILTING HOIST TACKLE

CROSS REFERENCE

This application is a continuation-in-part of my U.S. patent application Ser. No. 867,186, filed Apr. 25, 1986, which issued as U.S. Pat. No. 4,684,162 on Aug. 4, 1987.

TECHNICAL FIELD

This invention relates to tackle acting as an adjustable sling connected between a conventional hoist and a load to be lifted and allowing the load to be tilted and maintained in the tilted position.

BACKGROUND ART

When lifting a load with a hoist and a sling, it is sometimes desirable or required to tilt the load, such as when removing or installing the engine of a vehicle, which can require changing the attachment of the hoist to the sling.

Ehrhardt U.S. Pat. No. 3,391,957, issued July 9, 1968, discloses a "Universal Hoisting Fixture" in which the central portion of a single sling line is wound on a drum and the free ends of the line are connected to the load to be lifted. The drum can be turned for tilting the load. Prior to lifting the load the loose coils of sling line may become crossed or bind against each other on the frame supporting the drum making it difficult to rotate the drum. In addition, as the drum is rotated the coils of sling line have a tendency to progress toward a side of the frame and can exert substantial side pressure on the frame. Further, only the weight of the load tightening the coils on the drum deters the line from slipping relative to the drum, and in an extreme tilted position the load can slip toward a more horizontal position.

Other types of hoist tackle in which a sling line is wound on a drum are shown in: Caldwell U.S. Pat. No. 2,356,147, issued Aug. 22, 1944, Pridy U.S. Pat. No. 2,617,677, issued Nov. 11, 1952, Morith U.S. Pat. No. 2,620,218, issued Dec. 2, 1952, Young U.S. Pat. No. 3,254,913, issued June 7, 1966, Tattoo et al. GB patent No. 1,576,311, published Oct. 8, 1980, and Khark SU patent No. 1096187, issued June 7, 1984.

DISCLOSURE OF THE INVENTION

The tilting hoist tackle in accordance with the present invention includes a drum rotatably mounted in a block adapted to be connected to a conventional hoist and, preferably, two separate sling lines each with one end portion fitted through a slot in the drum and knobbed to secure such line end portion to the drum. The sling lines are wound in opposite senses around the drum and their free end portions are adapted to be connected at spaced locations to the load to be lifted Mechanism is provided for locking the drum relative to its block and, with the locking mechanism released, the drum can be rotated to haul in one sling line while paying out the other so as to tilt the load, whereupon the locking mechanism can be actuated to maintain the load in its tilted position One or more guide plates are provided to prevent the coils of sling lines from crossing or riding up on each other. The tackle is of simple and inexpensive construction, in compact form and easy to use, yet rugged and reliable for repeated use over a long period.

BRIEF DESCRIPTION OF THE DRAWINGS

FIG. 1 is a top perspective of tilting hoist tackle in accordance with the present invention with some parts shown in exploded relationship and some parts deleted;

FIG. 2 is a somewhat diagrammatic side elevation of the tilting hoist tackle of FIG. 1 in assembled condition, and FIG. 3 is a somewhat diagrammatic end elevation thereof with parts broken away;

FIG. 8 is a top perspective of a second form of tilting hoist tackle in accordance with the present invention with some parts shown in exploded relationship and some parts deleted;

FIG. 9 is a somewhat diagrammatic side elevation of the tilting hoist tackle of FIG. 8 in assembled condition, and FIG. 10 is a somewhat diagrammatic end elevation thereof with parts broken away;

BEST MODE FOR CARRYING OUT THE INVENTION

Figure 4:
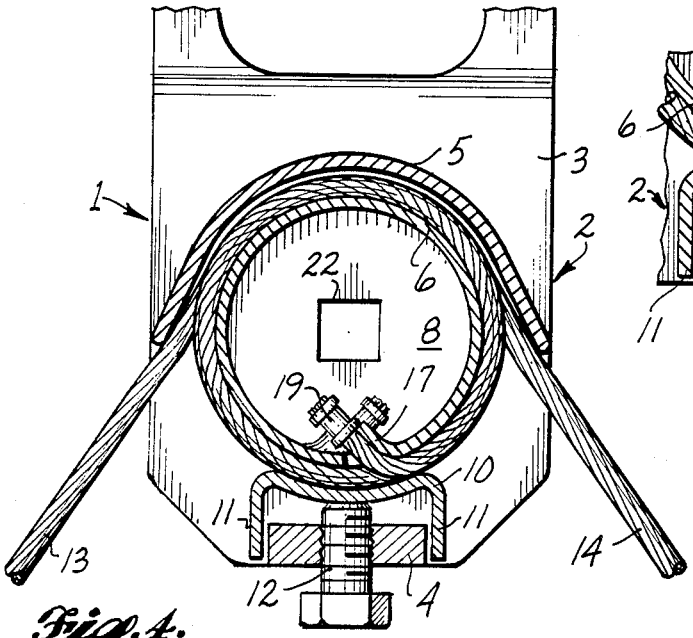
FIG. 4 is an enlarged, fragmentary, vertical, transverse section of the tilting hoist tackle of FIGS. 1, 2 and 3,.a d

As shown in FIGS. 1, 2 and 3, the tilting hoist tackle 1 in accordance with the present invention includes a frame or block 2 having complementary upright cheeks 3. The lower portions of the cheeks are maintained in spaced parallel relationship by a horizontal bottom cross plate 4 and an arcuate top cross plate 5 welded to the facing surfaces of the cheeks. The upper end portions of the cheeks are bent inward and are spot-welded together.

The drum 6 or the tackle is journaled in registered holes 7 in the lower portions of the cheeks between the two cross plates 4 and 5. The drum has a circular end plate 8 of a diameter greater than the holes 7 to limit insertion of the drum in its block. At the opposite end portion of the drum from its end, plate 8, the drum has an annular groove 9 for a snap ring 9' to prevent withdrawal of the drum from its block A U-shaped drum clamp 10 is fitted over the bottom cross plate 4 with its downward-projecting legs 11 preventing separation of the clamp from the tackle block after the drum is inserted Clamp legs 11 extend along the opposite ends of the bottom cross plate 4 and also guide the plate for up-and-down movement toward and away from the bottom of the drum. An upright lock bolt 12 is threaded upward through the bottom cross plate 4 so that its upper end portion bears against the web of clamp 10 which is arcuate to approximate the curvature of the drum Each of two separate sling lines 13 and 14 has one end portion secured to the drum 6. The free end portions of the sling lines carry connecting plates 15 with eyes 16 allowing them to be conveniently secured to the load to be lifted such as to the opposite end portions of a vehicle engine to be removed or installed.

Figure 6:
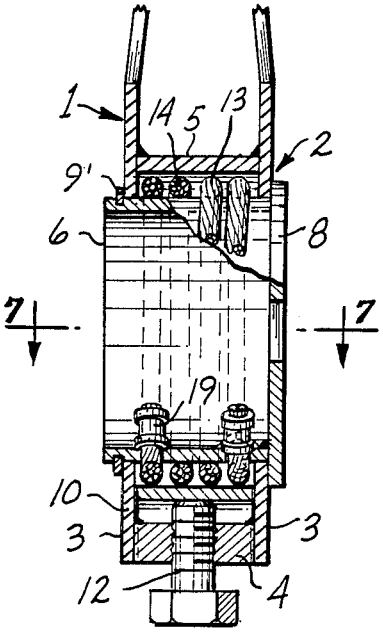
FIG. 6 is an enlarged fragmentary end elevation of the tilting hoist tackle of FIGS. 1, 2 and 3 with parts broken away.
Figure 7:
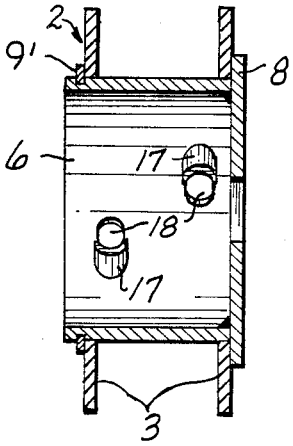
FIG. 7 is a horizontal section along line 7—7 of FIG. 6.

As best seen in FIG. 6, preferably the inner end portions of sling lines 13 and 14 are secured to the drum 6 adjacent to the opposite cheeks 3, respectively Each line is wound on the drum at least one and one-half revolutions from an end portion of the drum toward the longitudinal center of the drum For maximum strength and longevity of the lines, short narrow tabs 17 of the drum are punched inward to form narrow slots 18 through which the inner end portions of the lines can be threaded. The ends of the lines projecting inside of the drum are knobbed by crimped ferrules 19 of a diameter larger than the slots 18.

Figure 5:
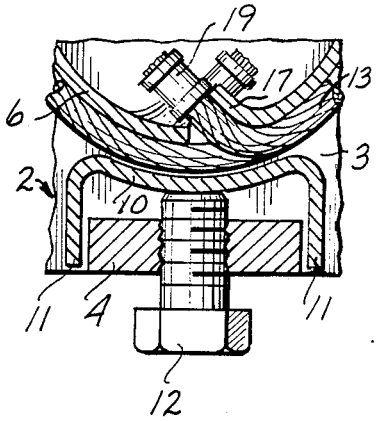
FIG. 5 is a further enlarged fragmentary, vertical transverse section thereof.

Preferably, each tab 17 is gradually curved inward with its inner end portion defining an acute angle of, preferably, about 45 degrees relative to a tangent of the drum in the area of the tab so that, as best seen in FIGS. 4 and 5, there is minimal bending of the inner end portion of the line. In addition, each tab is concave in cross section to fit closely over the periphery of its line adjacent to the corresponding ferrule. The outer side of each tab is approximately aligned with the inner side of the adjacent cheek leaving an unpunched structural joining section of the drum extending along the tab, and the tabs are spaced apart axially of the drum a distance at least equal to a multiple of the line diameter, and the tabs and their slots are spaced apart slightly circumferentially of the drum, so as not to affect the structural integrity of the drum. In the central position of the drum shown r.n the drawings where the free end portions of the lines 13 and 14 are of the same length, each line is wrapped around the drum precisely the same number of revolutions.

As best seen in FIG. 4, the top cross plate 5 is circular through an angle of more than 90 degrees, preferably about 120 degrees, and extends closely over the top of the drum from the locations of departure of the free end portions of the sling lines from the drum. Such plate acts as an arcuate guide and is spaced from the outer periphery of the drum a distance no greater than one and one-half times the line's diameter so that, with reference to FIG. 6, adjacent coils of line cannot cross or even ride up to a position where one coil is wedged between the plate and the adjacent coil Returning to FIG. 4, each of the open spaces between the ends of plate 5 and the ends of clamp 10 should encompass no more than 90 degrees of the drum circumference, preferably no more than about 60 degrees, which assures that the sling lines will not bind or cross even when the load is released With reference to FIGS. 2 and 3, the upper end portions of the cheeks 3 have registered apertures 20 forming an eye for convenient attachment to a conventional hoist such as by the hoist hook 21. The connecting plates 15 of the lines 13 and 14 are secured to the load to be lifted, such as at the opposite end portions of a vehicle engine. With the drum clamp 10 released by unscrewing the lock bolt 12, the drum can be turned to pay out one sling line and haul in the other and thereby tilt the load For this purpose, the drum end plate 8 has a central square socket hole 22 for receiving the standard square projection of a conventional ratchet. With the load tilted to the desired degree, lock bolt 12 is turned to raise clamp 10 so as to bear against the coils of lines 13 and 14 and thereby prevent additional turning of the drum The modified tilting hoist tackle 1' in accordance with the present invention shown in FIGS. 8 through 12 also includes the frame or block 2' with complementary upright cheeks 3'. A modified bottom cross plate 4' is welded to the facing surfaces of the opposite cheeks 3' and is of the same general shape as the clamp 10 of the previously described embodiment. Plate 4' has an arcuate upper surface closely encircling about 80 or 90 degrees of the lower portion of the drum 6' which is fitted in the registered apertures 7.

Figure 11:
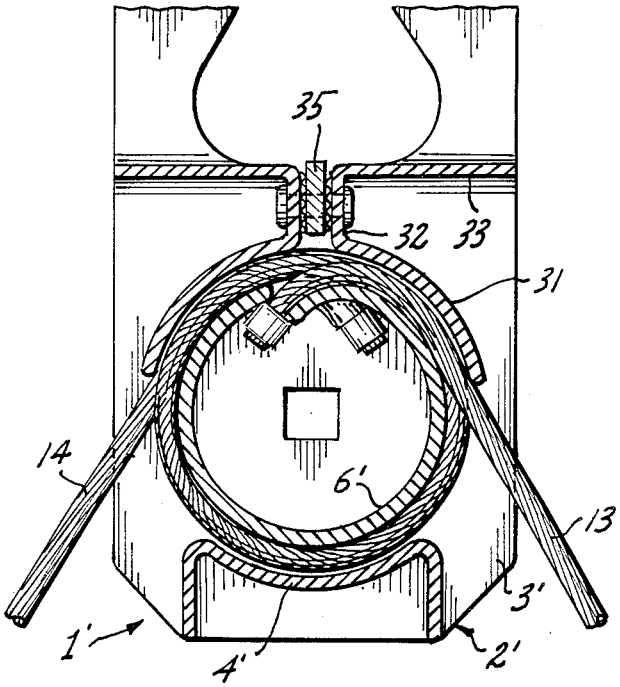
FIG. 11 is an enlarged, fragmentary, vertical, transverse section of the tilting hoist tackle of FIGS. 8, 9 and 10.
Figure 12:
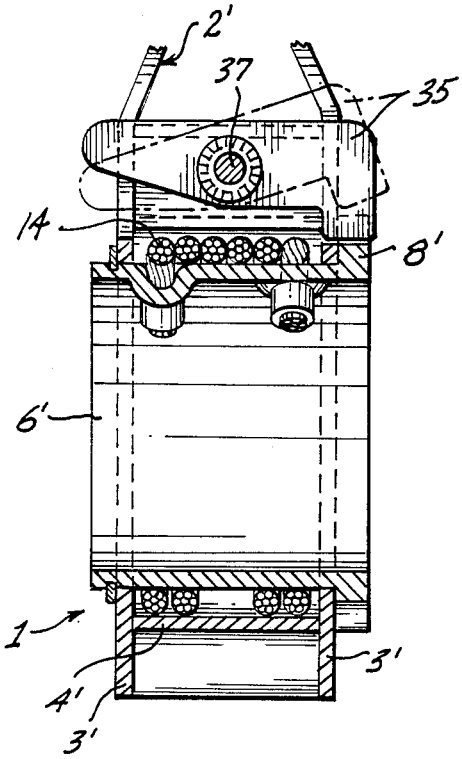
FIG. 12 is an enlarged fragmentary end elevation of the tilting hoist tackle of FIGS. 8, 9 and 10 with parts broken away.

The drum end plate 8' has radially extending slots 30 spaced uniformly around the circumference of the end plate The attachment of the drum 6' to the block 2' and the cables 13 and 14 to the drum are identical to the attachments used in the previously described embodiment The arcuate top cross plate 5 of the previously described embodiment is replaced by two separate but closely adjacent top cross plates 5', each of generally U-shape. Cross plates 5' have arcuate bottom portions 31 closely encircling the upper portion of the drum 6', parallel upright web portions 32 and horizontal top portions 33. The arcuate bottom portions 31 closely encircle at least 90 degrees, preferably about 120 degrees, of the drum circumference. As seen in FIG. 11, in the modified embodiment, as in the earlier described embodiment, there is less than 90 degrees, preferably no more than about 60 degrees, of open area between adjacent ends of the arcuate portion of the bottom cross plate 4' and the top cross plate portion 31 at the same side.

The cheeks 3' have upright slots 34 extending downward from the registered top apertures 20. Such slots are registered with the narrow space between the upright web portions 32 of the cross plates 5'. A locking lever or latch 35 can be fitted in the slots 34 between the guide plate portions 32. Such lever projects in opposite directions from its central pivot aperture 36 which receives a pin 37 extending between the top plate web portions 32. The opposite sides of the lever 35 are snugly engaged by washers fitted between such sides and the web portions 32.

As best seen in FIG. 10, the opposite ends of lever 35 project beyond the opposite outer sides of the cheeks 3'. One end portion of the lever, the end shown at the left in FIG. 10, can be moved up or down to swing the other end portion into or out of whichever radial slot 30 of the drum end plate 8' is registered with the lever. Preferably the lever is substantially balanced at opposite sides of its pivot axis and there is sufficient frictional engagement with its opposite sides that the lever stays reliably in the position to which it is swung.

Operation of the modified embodiment is identical to operation of the previously described embodiment with the exception of the manner in which the drum is locked to the block. With the lock lever 35 swung to the broken line position shown in FIG. 12, the drum can be turned to position the load at the desired angle, whereupon the lever can be moved to the solid line position shown in FIG. 12 where its hooked end is engaged in one of the slots 30 of the drum end plate 8' to prevent rotation of the drum in either direction.

I claim:

1. Tilting hoist tackle for connection between a hoist and a load to be lifted, characterized by the combination of a drum, a portion of said drum having generally radially extending slots spaced substantially uniformly circumferentially of said drum, a block adapted to be connected to the hoist and mounting said drum for rotation about a horizontal axis, sling line means wound on said drum and connectable to the load, and a latch lever pivotally mounted on said block for swinging about an axis offset from and extending transversely of the axis of rotation of said drum, said latch lever having a first portion swingable between a locking position received in one of said slots so as to prevent rotation of said drum in either sense relative to said block and an unlocked position removed from said slot so as not to interfere with rotation of said drum relative to said block and a second portion protruding from said block for manual access thereto for swinging of said lever to move its first portion between its locking and unlocked positions.

2. The tilting hoist tackle defined in claim 1, in which the latch lever is frictionally engaged so as to remain in whichever of its locking and unlocked positions to which it is moved until manually moved therefrom.

3. Tilting hoist tackle for connection between a hoist and a load to be lifted, characterized by the combination of a drum, a block adapted to be connected to the hoist and mounting said drum for rotation about a horizontal axis, said block including opposite upright cheeks and two cross plates extending between said cheeks and having generally radially extending web portions disposed in substantially parallel relationship, sling line means wound on said drum and connectable to the load a portion of said drum having generally radially extending slots spaced substantially uniformly circumferentially of said drum, and a latch lever pivotally mounted on said block between said web portions, said lever having an end portion swingable between a locking position received in one of said slots so as to prevent rotation of said drum relative to said block and an unlocked position removed from said slots so as not to interfere with rotation of said drum relative to said block.

4. The tilting hoist tackle defined in claim 3, in which the latch lever is frictionally engaged between the web portions so as to remain in whichever of its locking and unlocked positions to which it is moved until manually moved herefrom.

* * * * *